US011806305B2

(12) United States Patent
Illindala et al.

(10) Patent No.: US 11,806,305 B2
(45) **Date of Patent: *Nov. 7, 2023**

(54) CHEST COMPRESSION DEVICES FOR USE WITH IMAGING SYSTEMS, AND METHODS OF USE OF CHEST COMPRESSION DEVICES WITH IMAGING SYSTEMS

(71) Applicant: Zoll Circulation, Inc., San Jose, CA (US)

(72) Inventors: Uday Kiran V. Illindala, San Jose, CA (US); James Adam Palazzolo, San Jose, CA (US)

(73) Assignee: ZOLL Circulation, Inc., San Jose, CA (US)

( * ) Notice: Subject to any disclaimer, the term of this patent is extended or adjusted under 35 U.S.C. 154(b) by 776 days.

This patent is subject to a terminal disclaimer.

(21) Appl. No.: 16/887,858

(22) Filed: May 29, 2020

(65) Prior Publication Data

US 2020/0397653 A1 Dec. 24, 2020

Related U.S. Application Data

(63) Continuation of application No. 15/389,175, filed on Dec. 22, 2016, now Pat. No. 10,688,017, which is a (Continued)

(51) Int. Cl.
*A61H 31/00* (2006.01)
*A61H 11/00* (2006.01)

(52) U.S. Cl.
CPC ..... *A61H 31/006* (2013.01); *A61H 11/00* (2013.01); *A61H 31/00* (2013.01); (Continued)

(58) Field of Classification Search
CPC ..... A61H 31/006; A61H 11/00; A61H 31/00; A61H 2011/005; A61H 2201/01; (Continued)

(56) References Cited

U.S. PATENT DOCUMENTS 4,770,164 A 9/1988 Lach et al.
6,066,106 A 5/2000 Sherman et al.
(Continued)

FOREIGN PATENT DOCUMENTS

DE 19704032 8/1998
EP 2755622 7/2014
(Continued)

OTHER PUBLICATIONS

International Search Report and Written Opinion issued in international application No. PCT/US2012/055596 dated Nov. 29, 2012. (Previously submitted in related U.S. Appl. No. 15/389,175).
(Continued)

*Primary Examiner* — Quang D Thanh
(74) *Attorney, Agent, or Firm* — ZOLL Circulation, Inc.

(57) ABSTRACT

Devices and methods for performing CPR on a patient within an imaging field of an imaging device. The device has a compression belt and a belt tensioning mechanism, both located on or in the device such that the head, neck, thorax and abdomen of the patient may be place within the imaging field with the compression belt installed about the patient and the belt tensioning mechanism will be located outside of the imaging field.

21 Claims, 6 Drawing Sheets

Related U.S. Application Data continuation of application No. 14/172,764, filed on Feb. 4, 2014, now Pat. No. 9,532,924, which is a continuation of application No. 13/234,980, filed on Sep. 16, 2011, now Pat. No. 8,641,647.

(52) U.S. Cl.
CPC .... *A61H 2011/005* (2013.01); *A61H 2201/01* (2013.01); *A61H 2201/0103* (2013.01); *A61H 2201/1215* (2013.01); *A61H 2201/1246* (2013.01); *A61H 2201/149* (2013.01); *A61H 2201/165* (2013.01); *A61H 2201/169* (2013.01); *A61H 2201/1621* (2013.01); *A61H 2201/5007* (2013.01); *A61H 2201/5043* (2013.01); *A61H 2203/0456* (2013.01); *F04C 2270/041* (2013.01)

(58) Field of Classification Search
CPC .... A61H 2201/0103; A61H 2201/1215; A61H 2201/1246; A61H 2201/149; A61H 2201/1621; A61H 2201/165; A61H 2201/169; A61H 2201/5007; A61H 2201/5043; A61H 2203/0456; F04C 2270/041
See application file for complete search history.

(56) References Cited

U.S. PATENT DOCUMENTS

| | | | | |
|---|---|---|---|---|
| 6,142,962 | A | 11/2000 | Mollenauer et al. | |
| 6,282,736 | B1 | 9/2001 | Hand et al. | |
| 6,398,745 | B1 | 6/2002 | Sherman et al. | |
| 6,616,620 | B2 | 9/2003 | Sherman et al. | |
| 6,939,314 | B2 | 9/2005 | Hall et al. | |
| 7,122,014 | B2 | 10/2006 | Palazzolo et al. | |
| 7,347,832 | B2 | 3/2008 | Jensen et al. | |
| 7,354,407 | B2 | 4/2008 | Quintana et al. | |
| 7,404,803 | B2 | 7/2008 | Katz et al. | |
| 7,410,470 | B2 | 8/2008 | Escudero et al. | |
| 7,666,153 | B2 | 2/2010 | Hall et al. | |
| 8,641,647 | B2 | 2/2014 | Illindala et al. | |
| 9,532,924 | B2 * | 1/2017 | Illindala | A61H 31/00 |
| 10,688,017 | B2 * | 6/2020 | Illindala | A61H 31/00 |
| 2002/0177793 | A1 | 11/2002 | Sherman et al. | |
| 2003/0004445 | A1 | 1/2003 | Hall et al. | |
| 2004/0116840 | A1 | 6/2004 | Cantrell et al. | |
| 2004/0162587 | A1 | 8/2004 | Hampton et al. | |
| 2005/0080361 | A1 * | 4/2005 | Escudero | A61H 31/006 601/44 |
| 2005/0080364 | A1 * | 4/2005 | Jensen | A61H 31/006 601/44 |
| 2006/0116613 | A1 | 6/2006 | Halperin et al. | |
| 2007/0270725 | A1 | 11/2007 | Sherman et al. | |
| 2008/0146975 | A1 * | 6/2008 | Ho | A61H 31/006 601/44 |
| 2008/0319359 | A1 | 12/2008 | Moomiaie-Qajar et al. | |
| 2009/0204036 | A1 | 8/2009 | Halperin | |
| 2011/0040217 | A1 | 2/2011 | Centen | |
| 2011/0166489 | A1 | 7/2011 | Angold et al. | |
| 2013/0072830 | A1 | 3/2013 | Illindala et al. | |
| 2014/0155793 | A1 | 6/2014 | Illindala et al. | |
| 2017/0202734 | A1 | 7/2017 | Illindala et al. | |

FOREIGN PATENT DOCUMENTS

| | | |
|---|---|---|
| JP | 6279472 | 10/2014 |
| JP | 2014526949 | 10/2014 |
| WO | 2010119401 | 10/2010 |
| WO | 2013040470 | 3/2013 |

OTHER PUBLICATIONS

Extended European Search Report issued in European patent application No. 12831660.1 dated Jul. 6, 2015. (Previously submitted in related U.S. Appl. No. 15/389,175).
Hightower et al., Decay in Quality of Chest Compressions Over Time, Annals of Emergency Medicine, Sep. 1995, pp. 300-302, 26:3. (Previously submitted in related U.S. Appl. No. 15/389,175).
Tovar et al., Successful Myocardial Revascularization and Neurologic Recovery, Texas Institute Journal, 1995, pp. 271-273, 22:3. (Previously submitted in related U.S. Appl. No. 15/389,175).
Non-Final Office Action issued in U.S. Appl. No. 15/389,175 dated Jun. 3, 2015. (Previously submitted in related U.S. Appl. No. 15/389,175).
Final Office Action issued in U.S. Appl. No. 15/389,175 dated Nov. 5, 2015. (Previously submitted in related U.S. Appl. No. 15/389,175).
Non-Final Office Action issued in U.S. Appl. No. 15/389,175 dated Mar. 18, 2016. (Previously submitted in related U.S. Appl. No. 15/389,175).
Notice of Allowance issued in U.S. Appl. No. 15/389,175 dated Aug. 24, 2016. (Previously submitted in related U.S. Appl. No. 15/389,175).
Non-Final Office Action issued in U.S. Appl. No. 15/389,175 dated Jul. 18, 2013. (Previously submitted in related U.S. Appl. No. 15/389,175).
Notice of Allowance issued in U.S. Appl. No. 15/389,175 dated Nov. 21, 2013. (Previously submitted in related U.S. Appl. No. 15/389,175).
International Preliminary Report on Patentability issued in international application No. PCT/US2012/055596 dated Mar. 18, 2014. (Previously submitted in related U.S. Appl. No. 15/389,175).
Non-Final Office Action issued in U.S. Appl. No. 15/389,175 dated Sep. 23, 2019. (Submitted herewith).
Notice of Allowance issued in U.S. Appl. No. 15/389,175 dated Feb. 19, 2020. (Submitted herewith).

* cited by examiner

CHEST COMPRESSION DEVICES FOR USE WITH IMAGING SYSTEMS, AND METHODS OF USE OF CHEST COMPRESSION DEVICES WITH IMAGING SYSTEMS

RELATED APPLICATIONS

This application is a continuation of U.S. patent application Ser. No. 15/389,175 filed Dec. 22, 2016, which is a continuation of U.S. patent application Ser. No. 14/172,764 filed Feb. 4, 2014, now U.S. Pat. No. 9,532,924 which is a continuation of U.S. patent application Ser. No. 13/234,980 filed Sep. 16, 2011, now U.S. Pat. No. 8,641,647. All above identified applications are hereby incorporated by reference in their entireties.

FIELD OF THE INVENTIONS

The inventions described below relate to emergency medical devices and methods and the resuscitation of cardiac arrest patients.

BACKGROUND OF THE INVENTIONS

Cardiopulmonary resuscitation (CPR) is a well-known and valuable method of first aid used to resuscitate people who have suffered from cardiac arrest. CPR requires repetitive chest compressions to squeeze the heart and the thoracic cavity to pump blood through the body. Artificial respiration, such as mouth-to-mouth breathing or a bag mask apparatus, is used to supply air to the lungs. When a first aid provider performs manual chest compression effectively, blood flow in the body is about 25% to 30% of normal blood flow. However, even experienced paramedics cannot maintain adequate chest compressions for more than a few minutes. Hightower, et al., Decay In Quality Of Chest Compressions Over Time, 26 Ann. Emerg. Med. 300 (September 1995). Thus, CPR is not often successful at sustaining or reviving the patient. Nevertheless, if chest compressions could be adequately maintained, then cardiac arrest victims could be sustained for extended periods of time. Occasional reports of extended CPR efforts (45 to 90 minutes) have been reported, with the victims eventually being saved by coronary bypass surgery. See Tovar, et al., Successful Myocardial Revascularization and Neurologic Recovery, 22 Texas Heart J. 271 (1995).

In efforts to provide better blood flow and increase the effectiveness of bystander resuscitation efforts, various mechanical devices have been proposed for performing CPR. In one variation of such devices, a belt is placed around the patient's chest and the belt is used to effect chest compressions. Our own patents, Mollenauer et al., Resuscitation device having a motor driven belt to constrict/compress the chest, U.S. Pat. No. 6,142,962 (Nov. 7, 2000); Sherman, et al., CPR Assist Device with Pressure Bladder Feedback, U.S. Pat. No. 6,616,620 (Sep. 9, 2003); Sherman et al., Modular CPR assist device, U.S. Pat. No. 6,066,106 (May 23, 2000); and Sherman et al., Modular CPR assist device, U.S. Pat. No. 6,398,745 (Jun. 4, 2002), and our application Ser. No. 09/866,377 filed on May 25, 2001, show chest compression devices that compress a patient's chest with a belt. Each of these patents is hereby incorporated by reference in their entirety. Our commercial device, sold under the trademark AUTOPULSE®, is described in some detail in our prior patents, including Jensen, Lightweight Electro-Mechanical Chest Compression Device, U.S. Pat. No. 7,347,832 (Mar. 25, 2008) and Quintana, et al., Methods and Devices for Attaching a Belt Cartridge to a Chest Compression Device, U.S. Pat. No. 7,354,407 (Apr. 8, 2008).

These devices have proven to be valuable alternatives to manual CPR, and evidence is mounting that they provide circulation superior to that provided by manual CPR, and also result in higher survival rates for cardiac arrest victims. The AUTOPULSE® CPR devices are intended for use in the field, to treat victims of cardiac arrest during transport to a hospital, where the victims are expected to be treated by extremely well-trained emergency room physicians. The AutoPulse® CPR device is uniquely configured for this use: the components are stored in a lightweight backboard, about the size of a boogie board, which is easily carried to a patient and slipped underneath the patients thorax. The important components include a motor, drive shaft and drive spool, computer control system and battery.

In certain in-hospital situations, it is desirable to provide chest compressions with the AutoPulse® CPR device while imaging the patient. For example, doctors may wish to continue CPR compressions, or limit any interruptions in compressions, while the patient is placed within advanced imaging devices such an MRI device, fluoroscope system or CT scanner, X-Ray machine or any such imaging device to image the thorax, heart or coronary arteries of the patient, or the head of the patient.

This may be needed to assess trauma, visualize a catheter placement, or diagnose organ function. The current AutoPulse® CPR device can fit within the imaging device, but the number of metal components which would thus fall within the imaging area of the imaging device would make it difficult to obtain a usable image. The metal components create such large and numerous artifacts that the patient's anatomy is poorly visible in imaging devices. Under fluoroscopy, the anterior/posterior view is the most clinically useful view, but is totally disrupted by artifacts caused by the metal components. Under MRI, no images can be obtained at all, while under CT scanning, some useful images may be obtained but they are typically obscured with significant artifacts. When in use, the AutoPulse motor, drive spool and chassis is disposed beneath the heart of the patient, and this creates significant artifact in any scan of the thorax. When in use, the AutoPulse battery is disposed beneath the head of the patient, and this creates significant artifact in any scan of the head. For other mechanical CPR systems, such as the LUCAS® system, the artifact in thorax images is significantly greater. In addition, chest mounted CPR systems, in which significant large mechanisms are mounted above the chest, do not fit into the gantry of many imaging devices (the gantry is the donut-shaped part of the CT scanner that supports moving components as they pass over the patient project and detect x-rays to create a CT image). This includes the LUCAS® device and the THUMPER® mechanical CPR devices.

SUMMARY

The devices and methods shown below provide for an automated CPR with a device that can be used within an imaging device without creating substantial metal artifacts. The CPR device is based on the AutoPulse® device described in our previous patents, modified in that the backboard is substantially lengthened to extend well out of the imaging field of an CT Scanner or MRI imaging system, and the motor, battery and control systems are disposed outside of the imaging field. The linkage between the belt driving apparatus and the compression belt proper is provided through a system of straps and spindles which translate inferior/superior movement of belt at the point of attachment to the belt driving apparatus to anterior/posterior force on that portion of the belt disposed over the chest of the patient. The belt may be driven by a pneumatic piston with small volumes of air at pressures regularly supplied in hospitals, or it may be driven by the motor and batteries described in relation to the AutoPulse® CPR device in our prior patents.

The piston driven system, though ideally suited for the CPR device to be used in conjunction with an imaging device, can also be used as a primary power source in an compression belt CPR device similar to the AutoPulse® CPR device. Also, the spindle arrangement which transforms superior/inferior movement of the piston can be implemented in a short board version for use in the field.

DETAILED DESCRIPTION OF THE INVENTIONS

Figure 1:
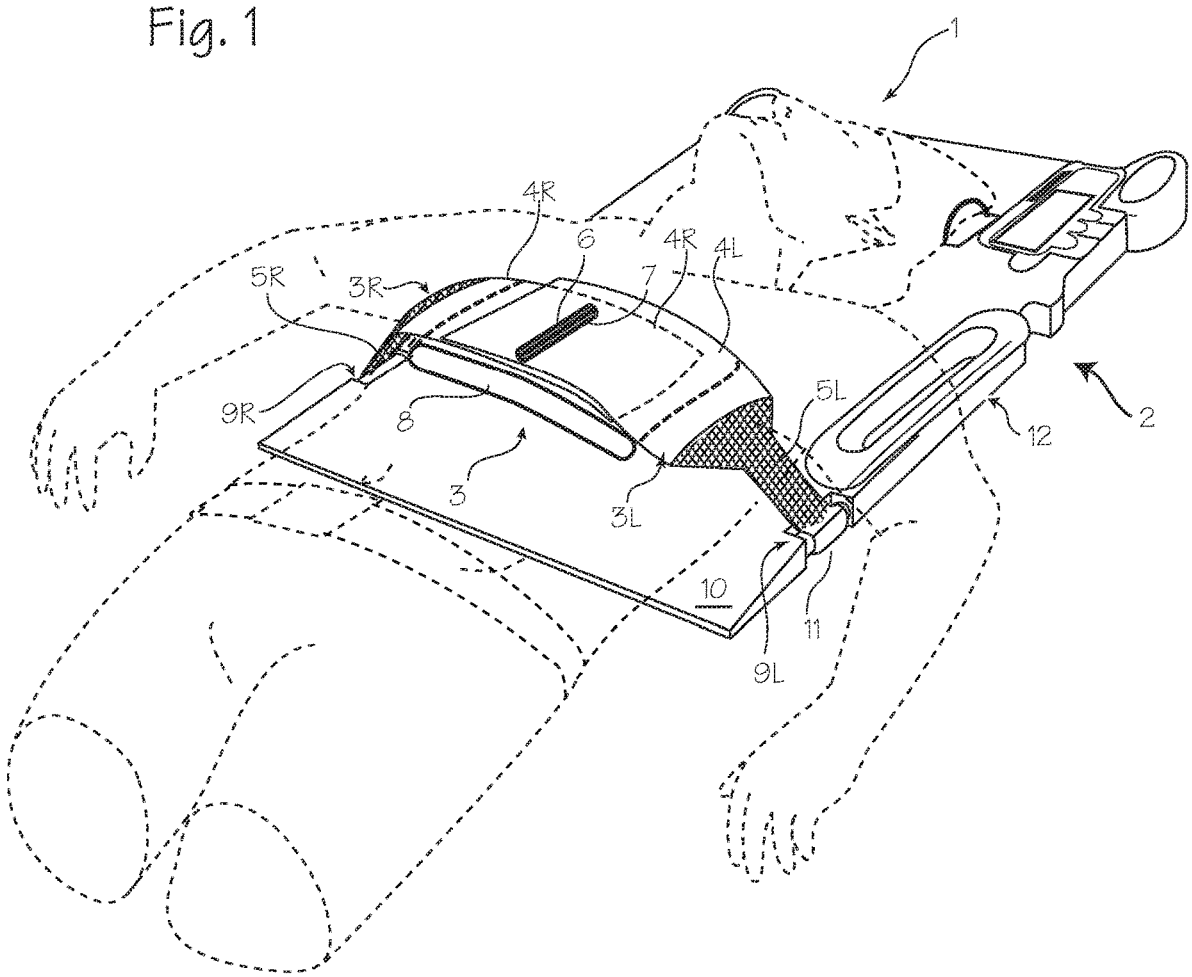
FIG. 1 shows the chest compression belt fitted on a patient.

FIG. 1 is a schematic drawing of our current chest compression system fitted on a patient 1. A chest compression device 2 applies compressions with the belt 3, which has a right belt portion 3R and a left belt portion 3L, including load distributing portions 4R and 4L designed for placement over the anterior surface of the patients chest while in use, and tensioning portions which extend from the load distributing portions to a drive spool, shown in the illustration as narrow pull straps 5R and 5L. The right belt portion and left belt portion are secured to each other with hook and loop fasteners and aligned with the eyelet 6 and protrusion 7. A bladder 8 is disposed between the belt and the chest of the patient. The narrow pull straps 5R and 5L of the belt are spooled onto a drive spool located within the platform (shown in FIG. 2) to tighten the belt during use, passing first over laterally located spindles 9L and 9R. The chest compression device 2 includes a platform 10 and a compression belt cartridge 11 (which includes the belt). The platform includes a housing 12 upon which the patient rests. Means for tightening the belt, a processor and a user interface are disposed within the housing. In the commercial embodiment of the device, the means for tightening the belt includes a motor, a drive train (clutch, brake and/or gear box) and a drive spool upon which the belt spools during use.

Figure 2:
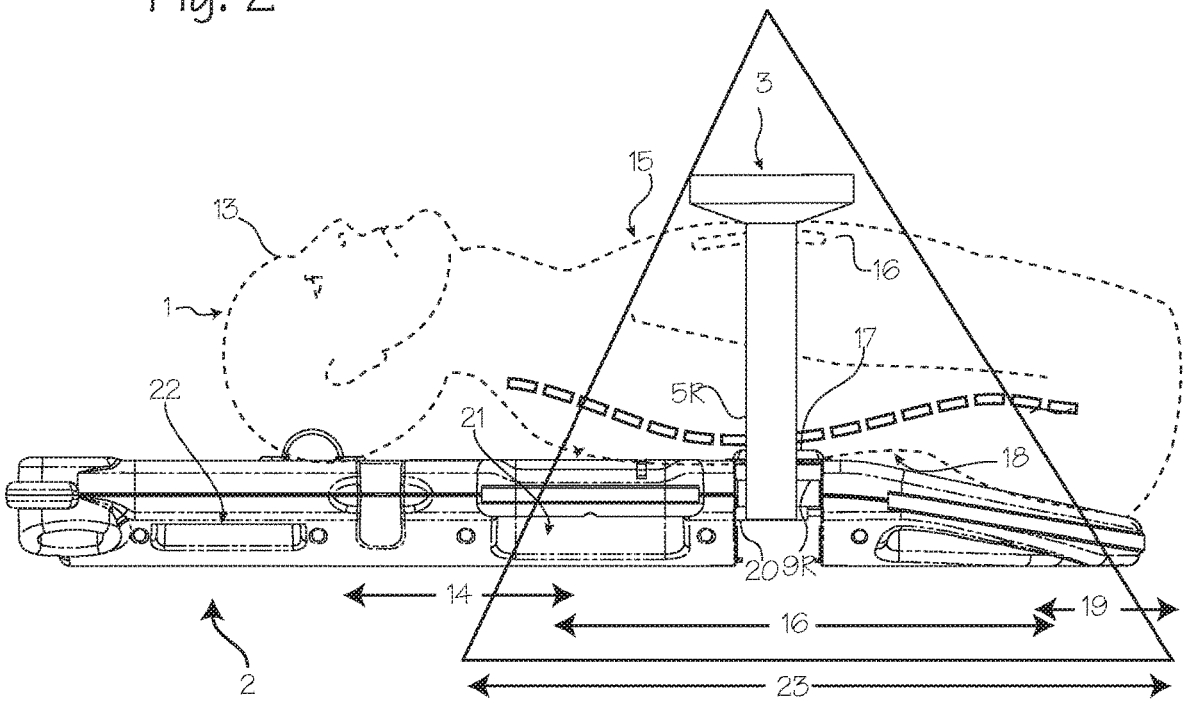
FIG. 2 illustrates the current AutoPulse® CPR device installed on a patient.

FIG. 2 illustrates the commercial embodiment of the device of FIG. 1, installed on a patient 1. The patient's head 13 rests on the headboard portion 14, the patient's thorax 15 rests over the thorax portion 16 and load plate 17, the lumbar portion of the patient's back 18 rests over the lumbar portion 19 of the housing and the patient's hips and legs extend past the housing (the hips and legs rest on the ground, gurney or other surface while the device is in use). The belt 3 extends from the drive spool 20, around the spindles 9R (and 9L on the opposite side of the patient) and over the anterior surface of the patient's chest. Thus, the belt is operably connected to the platform and adapted to extend at least partially around the chest of the patient, to provide anterior/posterior compression of the chest (the belt may extend substantially completely around the thorax of the patient if circumferential compression is desired). In use, the patient is placed on the housing and the belt is placed under the patient's axilla (armpits), wrapped around the patient's chest, and secured. The means for tightening the belt then tightens the belt repetitively to perform chest compressions. When installed properly, the motor 21 which drives the drive spool is disposed underneath the patients shoulders and neck, and large batteries 22 which power the motor are disposed within the housing under the patient's head, in the headboard portion of the housing. The control system and display in the commercial embodiment are disposed near the head of the patient. Depending on the imaging area of an imaging system, one or more of these parts creates significant artifacts in images produced through X-rays or MRI. The imaging field, also referred to as the scan field or scan field of view, which is produced by the imaging system, is represented by arrow 23, would encompass significant artifact creating structures in the AutoPulse® device, whether the imaging device is directed to the chest, neck or head. The term "imaging field" is used here to refer that area of the field of x-ray radiation, RF radiation, or magnetic flux used by the device to create and image, in which the introduction of ferrous metals (for MRI), metals (for CT scanning and digital subtraction angiography) and radiopaque materials (for CT scanning, digital subtraction angiography, fluoroscopes and X-rays) would create significant artifacts in the image provided by the imaging system.

Figure 3:
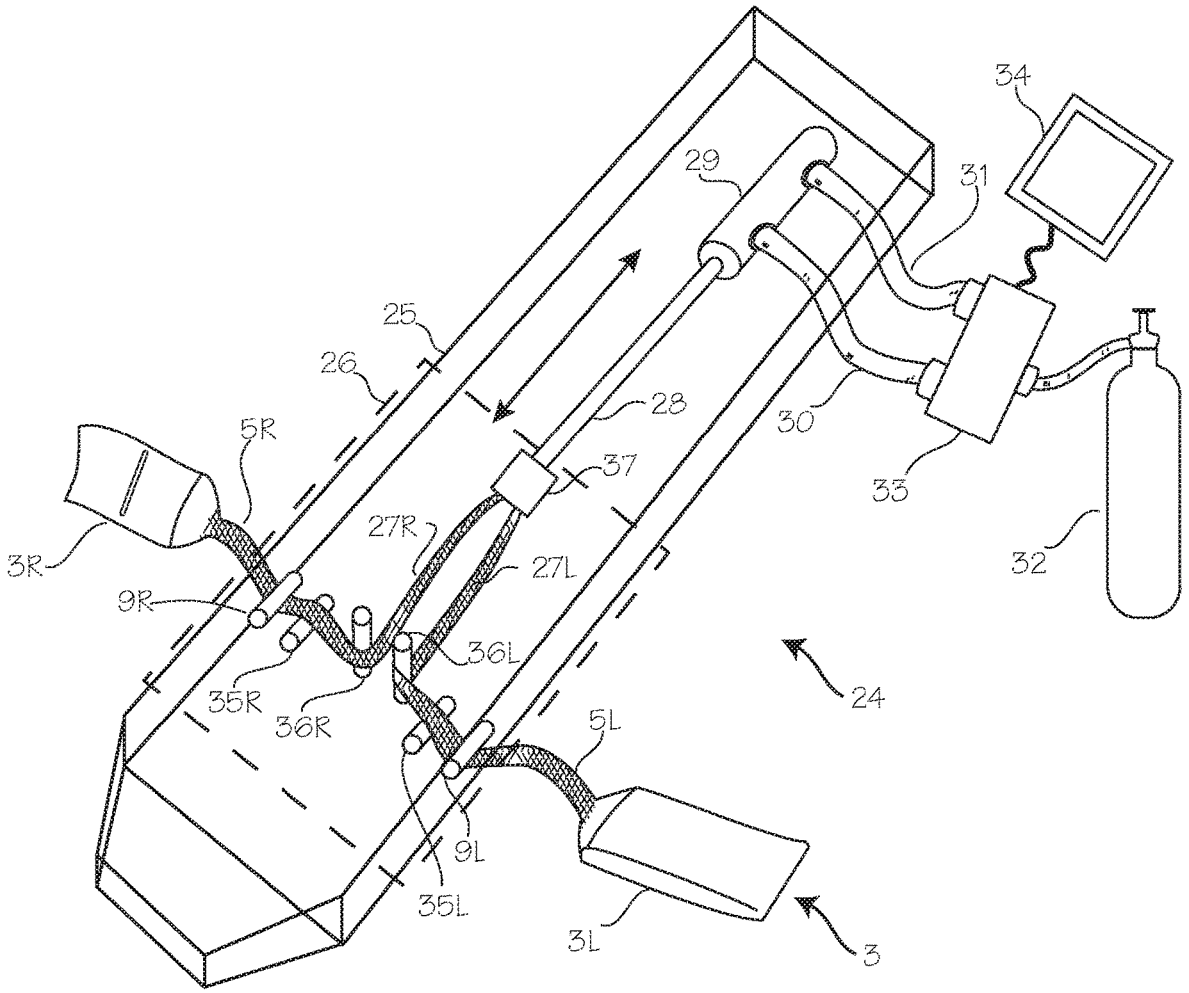
FIG. 3 illustrates the new CPR device, with modifications enabling its use in the imaging field of an imaging device.

FIG. 3 illustrates the new CPR device, with modifications enabling its use in the imaging field of an imaging device. FIG. 3 shows an automatic CPR device 24, based on the AutoPulse® device, in which artifact creating structures are disposed well outside the imaging field of an imaging system. The device includes a backboard 25, with the belt 3, which has a right belt portion 3R and a left belt portion 3L. The narrow pull straps 5L and 5R are threaded around spindles 9L and 9R which are comparable to the spindles used in the devices of FIGS. 1 and 2. This pair of spindles are oriented parallel to the patient's spine, and are disposed laterally in the housing so that they are under the axilla (armpit area) of the average patient. The backboard is extended superiorly, relative to the patient, to extend out of the imaging field depicted by box 26.

The pull straps 5L and SR continue with superior/inferior extension portions 27L and 27R that runs along the superior/inferior (head-to-toe vis-a-vis the patient) axis of the device to join an actuator rod 28 also extending along the superior/inferior axis of the device to a pneumatic piston 29. The pneumatic actuator and actuator rod, and the superior/inferior extension portions of the belt extend inferiorly/superiorly, relative to the patient, from the second set of spindles. The pneumatic piston is operable to pull the rod superiorly (upward relative to the patient) and thereby tighten the band around the patient and push the rod inferiorly (downward relative to the patient). The pneumatic piston is supplied with fluid through hoses 30 and 31, communicating with a pressurized fluid source 32 through valve 33. The valve may be controlled through control system 34. Using commonly available 150 psi (10.2 atmospheres) air supply, and an actuator with a volume of approximately 10 cubic inches (about 164 milliliters) or larger, and a stroke of about 6 inches (about 15.24 cm), the piston can pull and push the rod and thus pull and release the straps, such that the compression belt is tightened about the patient at a rate sufficient for CPR and a depth sufficient for CPR (i.e., at resuscitative rate and depth).

The superior/inferior tension and movement of the superior/inferior portions of straps 5L and 5R (labeled as 27L and 27R) is transformed to lateral tension and movement of the lateral portions of straps 5L and 5R by threading the straps downwardly from the patient, around the lateral spindles 9L and 9R to guide them medially (inwardly) around spindles 35L and 35R which are disposed medially to the lateral spindles and also oriented parallel to the superior/inferior axis of the device (generally parallel to the patient's spine, and with their axes horizontal in normal use). The straps are routed over the top of these medially located horizontal spindles, and then twist while running toward, and then inside centrally located, vertically oriented spindles 36L and 36R, and thereafter running to join the actuator rod at joint 37. The combined length of the superior/interior portions 27L and 27R of the strap, and the rod 28 (if it is MRI/CT compatible) are sufficient such that any MRI/CT incompatible or artifact-creating structures are well outside the imaging field. The spindles and any necessary hardware to secure them to the structure of the backboard are preferably made of MRI/CT compatible plastic, wood, metal (aluminum), ceramic or composite material. In place of the spindles, other translating means may be used to translate the superior/inferior movement of the linear actuator into downward tension on the pull straps and load distributing band, including gears, actuators and pulleys, though the pull straps and spindle arrangement shown in FIG. 3 works well. The means for translation, however, is preferably non-ferrous, non-metallic, and radiolucent. The rods and piston are preferably made of aluminum, but may also be made of any sufficiently MRI/CT compatible material (if they are positioned outside of the imaging field of an MRI device they may include ferrous metal in amounts insufficient to interact with the MRI magnetic fields). Specifically for use in an MRI fields, components may be made of stainless steel. The housing and backboard, along with any structural members in or near the imaging field, are preferably made of MRI/CT compatible plastic, wood, ceramic or composite material. The control system may be a computer control system, programmed to control the valve to alternately supply high pressure air to one side of the piston to pull the straps and then supply air to the other side of the piston to release tension on the straps (while in each case venting the other side of the piston), or an electromechanical control system. The control system may be a microprocessor or separate computer system, integrated into the backboard (as in the AutoPulse® device) spaced from the field of view, or a separate computer control system located remotely from the imaging device. To provide feedback regarding the effect of compressions, the load plate 17 and load cells shown in our U.S. Pat. No. 7,347,832 and in FIG. 2 may be placed on the upper surface of the platform, such that it is disposed under the patient's thorax when the system is installed on a patient. Also, the compression depth monitor may be used to provide feedback regarding the effect of compressions, as disclosed in out U.S. Pat. No. 7,122,014.

To effectuate the slack take-up function disclosed in our U.S. Pat. No. 6,616,620, the position of the actuator rod 28 can be detected with a linear encoder system, with an index on the actuator rod and a nearby encoder reader mounted within the platform, with an linear variable differential transformer (LVDT), string potentiometer, or other means for detecting the linear position of the actuator rod, or with the load cells. The point at which the belt has been tightened and there is no slack in the belt around the patient, and the belt is merely snug about the patient but has not exerted significant compressive force on the patient's chest, may be detected by sensing a rapid increase in the actuator pressure, a slow-down in the movement of the actuator rod (as determined by the encoder, LVDT or other means for detecting the linear position of the actuator rod, or a sharp initial increase in load on the load plate and load sensor. The control system may be programmed to detect such signals indicative of the point at which slack has been taken up, and establish the corresponding position of the actuator rod as a starting point for compressions.

Figure 4:
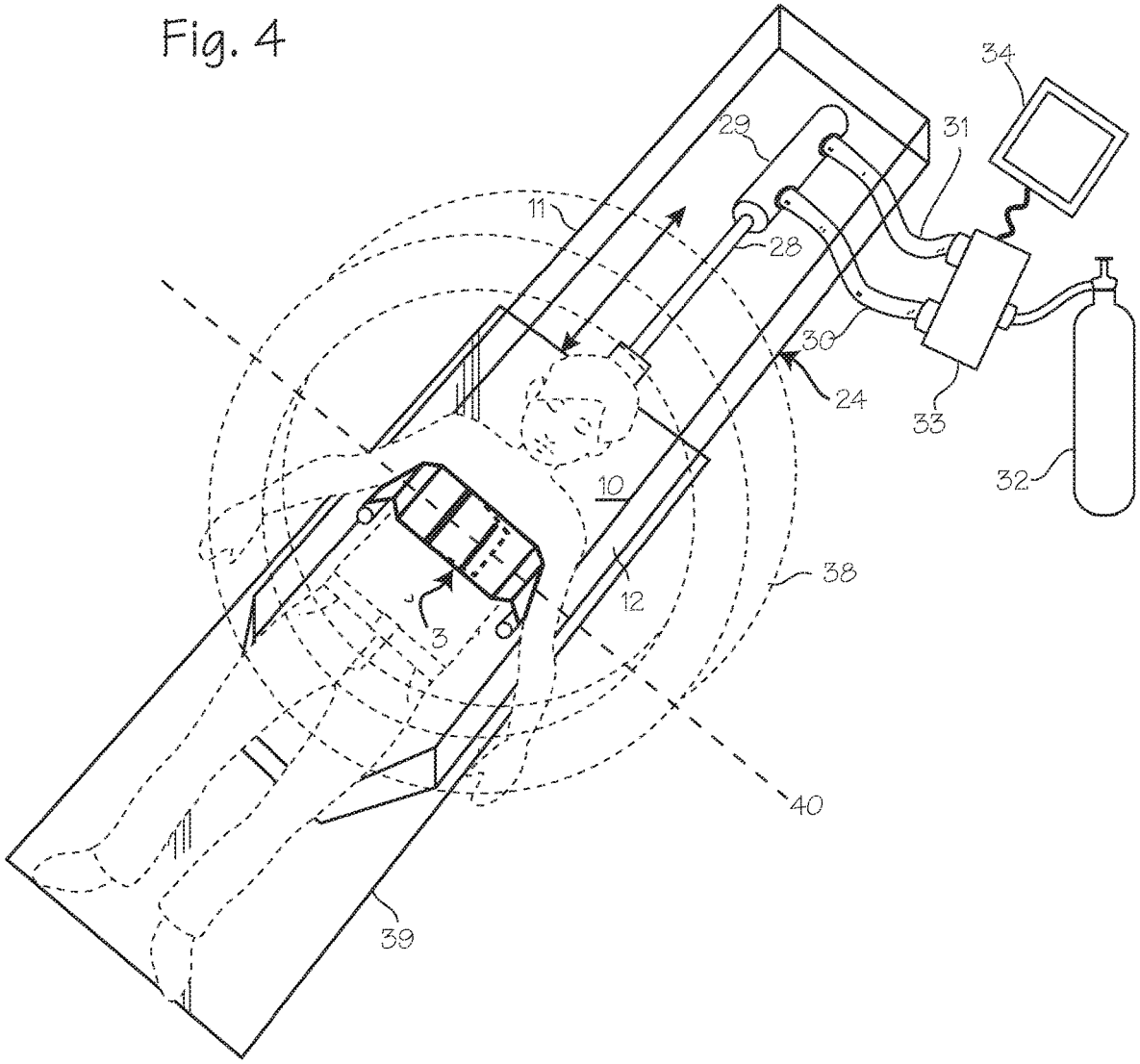
FIG. 4 illustrates use of the new CPR device within the imaging field of an imaging device.

The device of FIG. 3 is intended for providing CPR compressions while a patient is within the gantry of an imaging system. Use within the gantry of an imaging system will typically be desirable where the patient has been catheterized, and some event during the catheterization causes cardiac arrest, where the patient has suffered some trauma coincident with sudden cardiac arrest. Use within the gantry will also be desirable as a prophylactic measure for patients in heart failure, for which the supine position inhibits natural coronary blood flow. Use within the gantry will also be desirable for patients suffering from myocardial infarction and critical proximal disease of the left coronary artery, in case of cardiac arrest. As illustrated in FIG. 4, the patient is placed within the gantry 38 of an imaging system, which may be open or closed, while supported on a gurney 39. The chest compression device 24 installed about the patient, with the compression belt 3 secured about the thorax of the patient and the load distributing portion of the band and the bladder disposed over the chest anterior surface, with the long board disposed beneath the patient and extending superiorly out of the annulus or cylinder defined the gantry, and thus extending superiorly out of the imaging area. The platform 10 and housing 12 are adapted to be disposed beneath the patient's thorax while the patient is disposed within the gantry of an imaging system. The pneumatic actuator 29 and actuator rod 28 (or other linear actuator), valve 33 and control system 34 are located superiorly to the gantry, well out of the imaging field, when the load distributing portion of the belt is disposed within the imaging area. Preferably, as well, these components are located outside of the imaging field when others parts of the patient's anatomy (such as the abdomen, thorax, neck, or head) are inside the imaging field and the compression device is installed about the patient with the compression belt secured about the patient's thorax. To accomplish this, the actuator can be located superior to, or inferior to, the left-to-right centerline 40 of the belt.

The actuator and actuator rod may be operated as necessary to provide chest compressions, which may be halted momentarily for ventilation pauses normally associated with CPR. During these ventilation pauses, MRI or CT imaging system may be operated to image the patient, which entails broadcast of significant electromagnetic radiation (RF or X-rays, as the case may be), and imaging may be halted during compressions performed per ACLS guidelines. With appropriate coordination between the imaging device and the CPR device, the images may be taken at predetermined points in the compression cycle (such as complete relaxation of the belt, or peak compression of the patient), to obtain rough images or pilot images, and, depending on the frame rate of the imaging device, suitable diagnostically useful images.

To achieve such coordination, appropriate communications hardware and software in both the compression device and the imaging device can be used, and the compression device can send signals corresponding to the compression period/ventilation pause, or corresponding to individual compression cycles. In the first instance, the CPR controller or associated communications device will send signals to the imaging system that indicate that the CPR device is actively engaged in applying a series of chest compressions or is suspending chest compressions to allow for imaging (and ventilation) to be performed, and the imaging system or associated communication systems will receive the signals, and the control system of the imaging device, programmed appropriately, will suspend imaging during the period in which compressions are applied, and resume imaging during the period of suspension of compressions. In the second instance, the CPR controller or associated communications device will send signals to the imaging system that indicate the point of the compression cycle (that is, whether CPR device is holding the belt relaxed, is tightening the belt, is holding the belt tight, or is loosening the belt) and the imaging system or associated communication systems will receive the signals, and the control system of the imaging device, programmed appropriately, will suspend imaging during periods in each compression cycle, and resume imaging during other periods in each compression cycle, such that compression do not need to be suspended for imaging pauses or ventilation pauses. In this second instance, images may be obtained, for example, only during complete relaxation, or only during high-compression holds, in which the patient is expected to be stationary and the thorax quiescent. The acquisition of images may be gated, based on the input of a compression sensor (such as a load sensor under the patient's thorax, on the platform) or from a signal from the controller, that indicates that specific point in compression, such as the start of compress, start of the hold period, start of release, or end of a compression cycle (attainment of the slack take-up position of the belt), such that imaged are obtained at specific intervals (such as every ten milliseconds) after the chosen gating point in the compression cycle. For imaging systems with sufficiently high frame rates, useful images can be obtained. For imaging systems with very high frame rates (30 frames per second currently achievable with fluoroscopy), the compression device may be operated continuously and images may be obtained throughout the compression cycle, because such systems have been shown to image even a beating heart with no motion artifact. The operations described above can be accomplished with a single computer control system operable to control both the compression device and the imaging system, or by programming the control systems of each to communicate with each other.

Thus, the compression system can be operated to provide multiple CPR chest compressions in multiple periods separated by ventilation pauses, while performing the imaging during these ventilation pauses. The compression system can be operated to provide multiple CPR chest compressions, where each compression constitutes a compression cycle of tightening and relaxation and hold periods, and performing the imaging during hold periods. With sufficiently fast imaging systems, imaging may be performed throughout the compression cycle.

Figure 5:
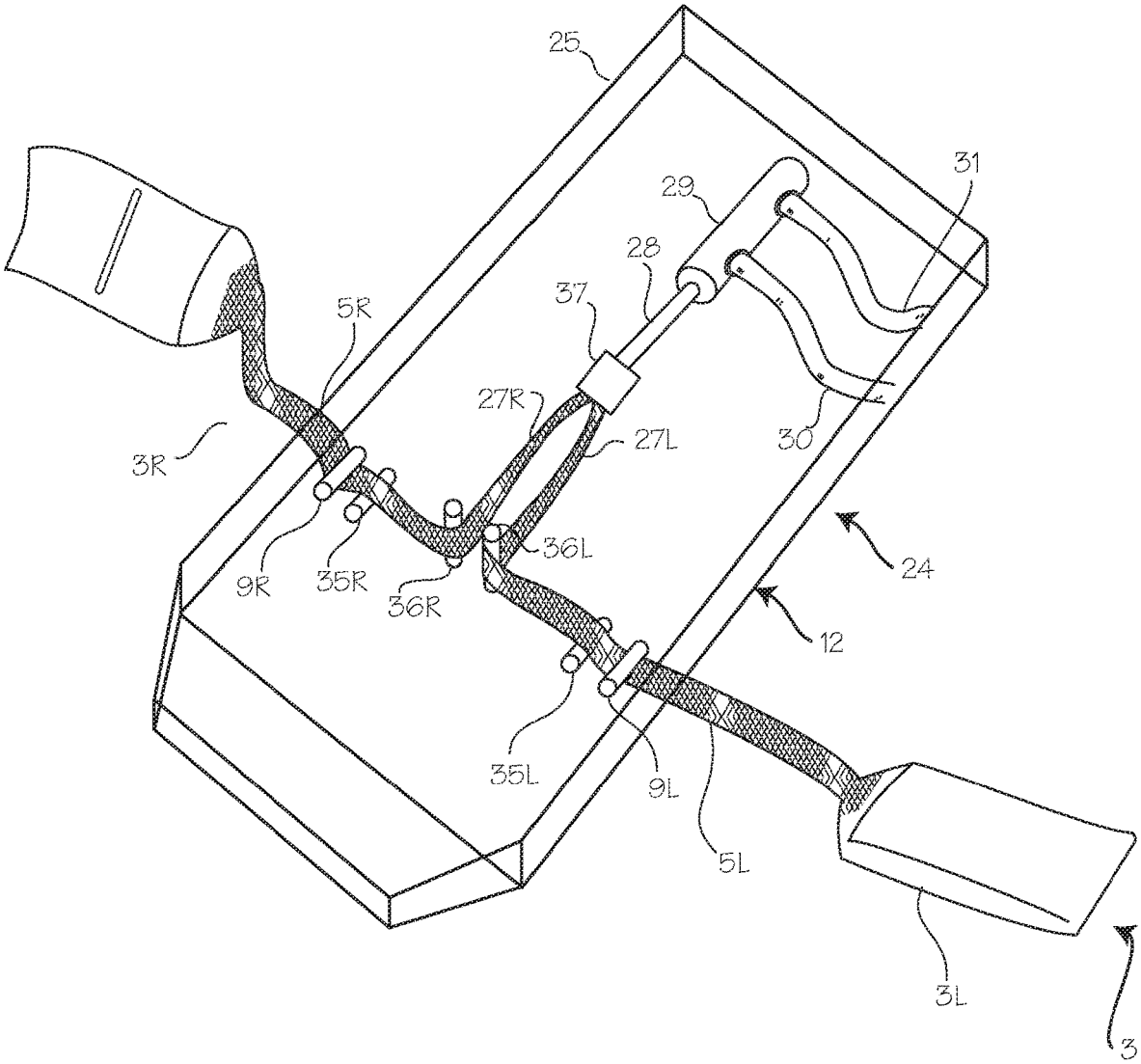
FIG. 5 illustrates a new CPR device which employs a pneumatic actuator or other linear actuator to tighten a chest compression band about the chest of the patient.

Several variations of the construction disclosed above provide the benefits of the various inventive aspects. FIG. 5 illustrates a new CPR device which employs a pneumatic actuator described above, or other linear actuator, to tighten a chest compression band about the chest of the patient. In this Figure, the actuator rod is very short, and the actuator is disposed in a short housing. The housing, as in the AutoPulse® CPR device, extends from the lumbar region of patient to the head of the patient (based on typical patient size), and the actuator piston is disposed within the housing. The device of FIG. 5 includes the housing 12, the belt 3 (including left and right portions 3L and 3R and strap portions 5L and 5R), horizontal lateral spindles 9L and 9R, medial spindles 35L and 35R, vertical and central spindles 36L and 36R for guiding the straps from the lateral course to the superior/inferior course, the joint 37 for joining the very short superior/inferior portion of the pull straps 27L and 27R to the actuator rod 28. In this version of the device, the piston is located within the short housing, in the portion of the housing which is disposed under the head or chest of the patient when in use. It may also be located in the housing in the portion corresponding the lower back of the patient, with the straps and spindles arranged appropriately. The pneumatic piston 29 is one of several tensioning means that can be used to pull the tensioning portions of the belt, and can be replaced with any linear actuator, any rotary-to-linear converter (such as a drive wheel and connecting rod arrangement), or a rotary actuator aligned to pull the straps along the superior/inferior axis, including a motor driven drive spool arrangement quite similar to the AutoPulse® configuration, mounted sideways such that the drive spool pulls the straps superiorly. The tensioning means may also include a manually operated lever arm, attached directly or indirectly to the actuator rod 28 or the superior/inferior portions 27L and 27R of the pull straps, with means for translating predetermined arc of movement of the lever arm to the desired travel of the pull straps, and means for fitting the device for the patient. The platform 25 or the major components may be incorporated into the gurney of the imaging system, with the driving components (piston, valve, etc. disposed outside the imaging area in either the lower limb portion of the gurney or a superior portion of gurney, gurney's dimensions can be extended superiorly to accommodate the components.

Figure 6:
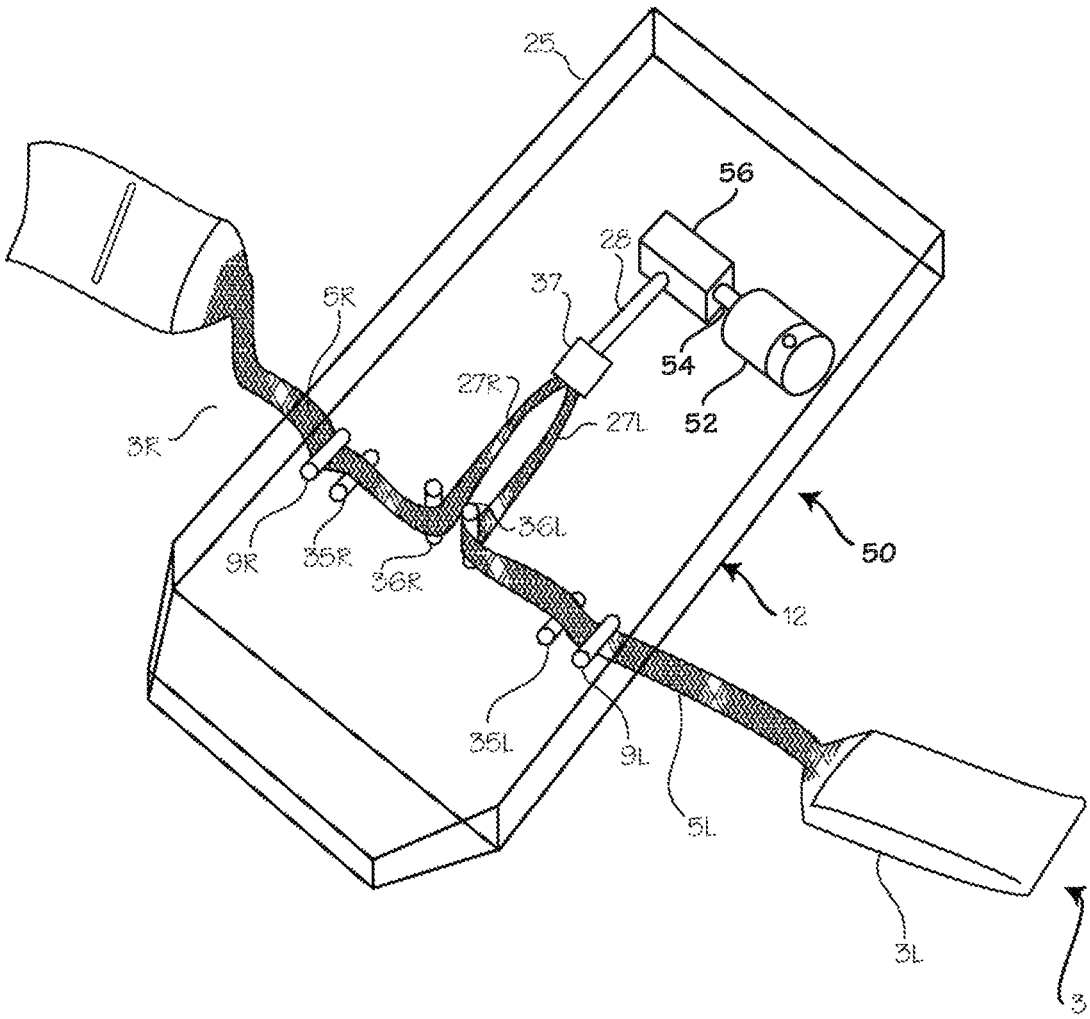
FIG. 6 illustrates another new CPR device configured for use in the imaging field of an imaging device.

For example, FIG. 6 illustrates an automatic CPR device 50, according to an exemplary embodiment. The device 50 has a tensioning means including a motor driven drive spool arrangement where a motor 52 is mounted sideways (e.g., transversely to the superior-inferior direction). A drive shaft or drive spool 54 operably connected to the motor 52 is configured to cause the straps 27L and 27R to be pulled along the superior-inferior axis. A rotary to linear converter 56, connected between the rotary actuator (e.g., motor 52 and drive shaft or drive spool 54) and the straps 27L and 27R, is operable to pull the straps 27L and 27R superiorly.

While described in relation to its use with imaging devices such as MRI and CT imaging systems, the CPR chest compression device may be used with any diagnostic device for which the presence of metal, motors, circuitry and batteries obscure the diagnostic information or otherwise disrupt the diagnostic method. Thus, while the preferred embodiments of the devices and methods have been described in reference to the environment in which they were developed, they are merely illustrative of the principles of the inventions. Other embodiments and configurations may be devised without departing from the spirit of the inventions and the scope of the appended claims.

We claim:

1. A device for compressing a chest of a patient while imaging the patient in an imaging system, the imaging system defining an imaging area which encompasses a portion of a thorax of the patient, the device comprising:

a platform configured to be disposed beneath the thorax of the patient;

a belt operably connected to the platform and adapted to extend at least partially around the chest of the patient, the belt comprising:

a load distributing portion adapted to extend across the chest of the patient, and tensioning portions configured to extend from the load distributing portion and posteriorly relative to the patient when the patient is disposed on the platform; and a mechanical actuator disposed relative to the load distributing portion of the belt such that the mechanical actuator is located entirely outside of the imaging area when the patient is disposed on the platform with the belt extending around the chest of the patient and the platform is disposed within a gantry of the imaging system, wherein the mechanical actuator is one of a linear actuator or rotary actuator, and the mechanical actuator is in a housing of the platform, wherein the mechanical actuator is configured to be disposed superior to, or inferior to, a transverse plane transecting the chest of the patient at a left-to-right centerline of the belt when the patient is disposed on the platform.

2. The device of claim 1, further comprising a translating apparatus for translating motion of the mechanical actuator into anterior/posterior tension in the tensioning portions.

3. The device of claim 2, wherein the tensioning portions are left and right tensioning portions extending downwardly toward the translating apparatus; and the translating apparatus comprises a set of spindles disposed in the housing of the platform, wherein a left spindle of the set of spindles is aligned laterally with a right spindle of the set of spindles, and the right and left spindles are aligned inferiorly/superiorly relative to the patient.

4. The device of claim 3, wherein the translating apparatus comprises a second set of spindles disposed medially relative to the set of spindles, wherein the second set of spindles are each aligned anteriorly/posteriorly relative to the patient; and the mechanical actuator is a linear actuator operably connected to the tensioning portions of the belt.

5. The device of claim 4, wherein the linear actuator comprises a pneumatic actuator with an actuator rod; and the tensioning portions of the belt extend inferiorly/superiorly from the second set of spindles to the actuator rod.

6. The device of claim 5, wherein the pneumatic actuator with the actuator rod is disposed outside the imaging area of an imaging device when the load distributing portion of the belt is disposed about the thorax of the patient and a head, a neck or an abdomen of the patient are disposed within the imaging area and the platform is disposed within the gantry of the imaging system.

7. The device of claim 4, wherein the linear actuator comprises a rotary-to-linear converter.

8. The device of claim 2, wherein the translating apparatus comprises spindles disposed in the housing of the platform, wherein a first set of spindles are configured to guide the tensioning portions on either side of a body of the patient from an anterior/posterior direction to a lateral/medial direction, and a second set of spindles are configured to guide the tensioning portions from the lateral/medial direction to a superior/inferior direction.

9. The device of claim 8, wherein the mechanical actuator comprises a linear actuator connected to the tensioning portions and aligned along the superior/inferior direction in order to pull the tensioning portions superiorly or inferiorly relative to the patient.

10. The device of claim 1, wherein the mechanical actuator comprises a pneumatic piston with an actuator rod secured to the tensioning portions of the belt.

11. The device of claim 1, wherein the mechanical actuator comprises a linear actuator secured to the tensioning portions of the belt.

12. The device of claim 1, wherein the mechanical actuator comprises a rotary-to-linear converter secured to the tensioning portions of the belt.

13. The device of claim 1, wherein the mechanical actuator comprises a rotary actuator aligned to pull the tensioning portions of the belt along a superior/inferior direction.

14. The device of claim 1, wherein the mechanical actuator comprises a motor with a drive shaft oriented transversely to a superior/inferior direction.

15. An automated chest compression device configured for compatibility with imaging a portion of a thorax of a patient in an imaging system, the automated chest compression device comprising:

a platform configured to be disposed beneath the thorax of the patient, the platform comprising a housing;

a mechanical actuator disposed within the housing of the platform, wherein the mechanical actuator is a linear actuator or a rotary actuator; and a compression belt configured to extend across a chest of the patient, the compression belt comprising a left tensioning portion and a right tensioning portion relative to the patient when the patient is disposed on the platform;

wherein the mechanical actuator is arranged in the housing of the platform to define an imaging compatible region disposed beneath a region of the thorax of the patient including a heart of the patient, wherein the mechanical actuator is disposed in the housing of the platform such that it is configured to be superior to or inferior to a left-to-right centreline of the compression belt when the compression belt is extended across the chest of the patient, and the imaging compatible region is devoid of any portion of the mechanical actuator.

16. The automated chest compression device of claim 15, further comprising a translating apparatus including a set of spindles configured to guide the left and right tensioning portions from an anterior/posterior direction to a lateral/medial direction.

17. The automated chest compression device of claim 16, wherein the translating apparatus further comprises a second set of spindles operably disposed between the set of spindles and the mechanical actuator, wherein the second set of spindles are configured to guide the left and right tensioning portions from the lateral/medial direction to a superior/inferior direction.

18. The automated chest compression device of claim 16, wherein a left spindle of the set of spindles is aligned laterally with a right spindle of the first set of spindles; and the right and left spindles are configured to be aligned inferiorly/superiorly relative to the patient when the patient is disposed on the platform.

19. The automated chest compression device of claim 15, wherein the mechanical actuator is configured to be aligned inferiorly/superiorly relative to the patient when the patient is disposed on the platform.

20. The automated chest compression device of claim 15, wherein the imaging compatible region, when the platform is disposed in a gantry of an imaging device, generally corresponds to an imaging field defined by the imaging device.

21. The automated chest compression device of claim 20, wherein the automated chest compression device is configured to provide compressions while disposed in the gantry of the imaging device.

* * * * *